US006229983B1

(12) United States Patent
Sawada

(10) Patent No.: US 6,229,983 B1
(45) Date of Patent: May 8, 2001

(54) IMAGE FORMATION APPARATUS HAVING CONTROLLER FOR CUTTING RECORDING MEDIUM

(75) Inventor: Yasushi Sawada, Mitaka (JP)

(73) Assignee: Copyer Co., Ltd., Tokyo (JP)

( * ) Notice: Subject to any disclaimer, the term of this patent is extended or adjusted under 35 U.S.C. 154(b) by 0 days.

(21) Appl. No.: 09/355,258

(22) PCT Filed: Jan. 28, 1998

(86) PCT No.: PCT/JP98/00336

§ 371 Date: Sep. 9, 1999

§ 102(e) Date: Sep. 9, 1999

(87) PCT Pub. No.: WO98/33653

PCT Pub. Date: Aug. 6, 1998

(30) Foreign Application Priority Data

Jan. 31, 1997 (JP) ..... 9-19417
Jan. 31, 1997 (JP) ..... 9-19418

(51) Int. Cl.[7] ..... G03G 15/00
(52) U.S. Cl. ..... 399/385
(58) Field of Search ..... 399/384, 385

(56) References Cited

U.S. PATENT DOCUMENTS 4,839,732 * 6/1989 Murakami et al. ..... 399/385 X
5,751,298 * 5/1998 Crowley ..... 399/385 X

FOREIGN PATENT DOCUMENTS 6-1022 1/1994 (JP) .
8-337023 12/1996 (JP) .

* cited by examiner

*Primary Examiner*—Fred L Braun
(74) *Attorney, Agent, or Firm*—Dellett and Walters

(57) ABSTRACT

An image is formed on roll paper 72, while a loop 72*a* of roll paper is formed between cutter 100 and roll paper feed rollers 88,89 is formed. At a timing when roll paper feed rollers 84,86 stop, an upstream portion of loop 72*a* in the paper feed direction is cut. A nipping member upstream of the cutter in the paper feed direction is provided to nip the front end of the roll paper. Further, a movable guide for the roll paper guides the paper to form a loop in a direction to correct curling of the roll paper. Thus an image formation apparatus is provided which is easy to handle and enables formation of an image on a recording paper having a large feed paper direction length, despite its small size.

12 Claims, 9 Drawing Sheets

IMAGE FORMATION APPARATUS HAVING CONTROLLER FOR CUTTING RECORDING MEDIUM

TECHNICAL FIELD

The present invention relates to an image formation apparatus for forming an image on roll paper or a cut paper sheet.

BACKGROUND TECHNIQUE

Ink-jet type image formation apparatuses for forming images by ink ejection on a printing medium, and electrophotography type image formation apparatuses for forming images by use of a developer on a printing medium are known as the output device of computers and workstations. Some of the image formation apparatuses are of the type which uses selectively cut paper sheets or roll paper as the printing medium. Some of them are of the type which uses roll paper only. An image formation apparatus which uses roll paper is usually equipped with a roll paper holder, and the roll paper is fed to an image formation section to form an image.

The roll paper is delivered usually by pairs of delivery rollers in a paper feed direction to the image formation section. The known delivery roller pairs include roll paper feed rollers which are contained in the roll paper holder and provided above the roll paper, roll paper delivery rollers which are provided on the downstream side of the roll paper feed rollers in the paper feed direction, and registration rollers which are provided on the downstream side of the roll paper delivery rollers. A cutter is provided between the roll paper feed rollers and the roll paper delivery rollers to cut the roll paper into a predetermined size of recording paper sheets by moving in a direction perpendicular to the paper feed direction.

In formation of an image on roll paper, the roll paper caught and delivered by the roll paper feed rollers and related members is once stopped and is cut by the cutter into a prescribed size of a recording paper sheet before the image formation. Then the front end of the recording paper of the prescribed size is brought into contact with the registration rollers, and is fed to the image formation section with the timing of image formation to form an image. Therefore, the maximum length of the recording paper in the paper feed direction is limited to be nearly equal to the distance between the cutter and the registration roller.

Accordingly, in order to form an image on a recording paper long in the paper feed direction, an image formation apparatus of a large size should be used in which the cutter and the registration rollers are separated in a long distance. However, the size of the image formation apparatus is limited by the installation space, so that the length of the recording paper is also limited. Therefore, an image is not readily formed on a recording paper sheet longer in the paper feed direction, and the image formation apparatus therefor is not easily handleable.

When the recording paper sheet cut in the prescribed size is delivered to the image formation section, the remaining roll paper is kept uncut and waiting at the position where the delivered paper sheet has been cut. The cutter, when it returns to the home position, may touch the front end of the remaining roll paper to cause cutting of the front end or other inconveniences. The cut front end portion may cause paper jamming or other trouble. This makes the image formation apparatus less handleable.

DISCLOSURE OF THE INVENTION

Under the above circumstances, the present invention intends to provide an image formation apparatus more readily handleable.

A first embodiment of the image formation apparatus of the present invention, for achieving the above object, has a roll paper holder for holding a roll paper, first delivery rollers for delivering the roll paper from the roll paper holder in a paper feed direction, a cutter placed on a downstream side of the first delivery rollers in the paper feed direction for cutting the roll paper, second delivery rollers placed on the downstream side of the cutter in the paper feed direction for delivering the roll paper in the paper feed direction; and forms an image on the roll paper delivered by the first delivery rollers and the second delivery rollers:

The image formation apparatus comprising (1) a first controlling means which controls the cutter, the first delivery rollers, and the second delivery rollers so as to form a loop of the roll paper between the first delivery rollers and the second delivery rollers, to form an image on the roll paper before cutting, and to cut the roll paper with the cutter with a prescribed timing.

A second embodiment of the image formation apparatus of the present invention, for achieving the above object, has a roll paper holder for holding a roll paper, first delivery rollers for delivering the roll paper from the roll paper holder in a paper feed direction, a cutter placed on the downstream side of the first delivery rollers in the paper feed direction for cutting the roll paper, second delivery rollers placed on the downstream side of the cutter in the paper feed direction for delivering the roll paper in the paper feed direction; and forming an image on the roll paper having been delivered by the first delivery rollers and the second delivery rollers:

The image formation apparatus comprising (2) a second controlling means which controls the cutter, the first delivery rollers, and the second delivery rollers to stop once the roll paper delivered by the first delivery rollers and the second delivery rollers and to cut the roll paper before image formation on the roll paper, when an image formation portion of the roll paper is not longer than a prescribed length in the paper feed direction; or to form a loop of the roll paper between the first delivery rollers and the second delivery rollers, to form an image on the roll paper before cutting, and to cut the roll paper with the cutter with a prescribed timing, when an image formation portion of the roll paper is longer than the prescribed length in the paper feed direction.

The image formation apparatus may have (3) a movable guide which is placed between the cutter and the second delivery rollers and guides the roll paper delivered by the first and the second delivery rollers to form a loop in a direction to correct curling inclination of the roll paper.

The image formation apparatus may have (4) third delivery rollers which are placed on the downstream side in the paper feed direction of the second delivery rollers to form a loop by contact with the recording paper and to deliver the recording paper in the paper feed direction to meet the timing of image formation, and (5) a third controlling means which controls the second delivery rollers to stop before the roll paper having passed through the second delivery rollers forms a loop by contact with the third delivery rollers.

A third embodiment of the image formation apparatus of the present invention, for achieving the above object, is equipped with a roll paper holder for holding a roll paper, first delivery rollers for delivering the roll paper from the roll paper holder in a paper feed direction, and a cutter placed on the downstream side of the first delivery rollers in the paper feed direction for cutting the roll paper delivered from the first delivery rollers into a prescribed size of a recording paper sheet; and forms an image on the recording paper sheet of the prescribed size: the image formation apparatus comprising (6) a nipping member placed on the upstream side of the cutter in the paper feed direction to nip the front end of the remaining roll paper separate from the cut recording paper of the predetermined size.

The image formation apparatus may have (7) a first controlling means which controls the first delivery rollers to move the front end of the remaining roll paper backward, after the cutting of the roll paper by the cutter, to the position where the front end is nipped by the nipping member.

The image formation apparatus may have (8) a detection sensor which is placed at a reference position between the position of nipping of the front end of the remaining roll paper by the nipping member and the position of the first delivery rollers for measuring the delivery amount of the roll paper and detects the roll paper, and (9) the first controlling means which controls the first delivery rollers to move the front end of the remaining roll paper backward from the position of nipping of the front end by the nipping member to the detection position of the detection sensor with a prescribed first timing.

A fourth embodiment of the image formation apparatus of the present invention, for achieving the above object, has a roll paper holder for holding a roll paper, a first delivery rollers for delivering the roll paper from the roll paper holder in a paper feed direction, a cutter placed on a downstream side of the first delivery rollers in the paper feed direction for cutting the roll paper delivered from the first delivery rollers into a prescribed size of recording paper sheet, and second delivery rollers placed on the downstream side of the cutter in the paper feed direction to deliver the recording paper sheet of the prescribed size in the paper feed direction; and forms an image on the recording paper sheet of the prescribed size: the image formation apparatus comprising a second controlling means

(10) for controlling the cutter, the first delivery rollers, and the second delivery rollers to form an image on the roll paper while forming a loop of the roll paper between the first delivery rollers and the second delivery rollers, and to cut the roll paper by the cutter with a prescribed second timing to obtain a recording paper sheet of the prescribed size, and

(11) for controlling the cutter to return to the home position when the rear end of the recording paper sheet of the prescribed size has passed through the second delivery roller.

BEST MODE FOR PRACTICING THE INVENTION

The mode of practicing the present invention is described below by reference to drawings.

Figure 1:
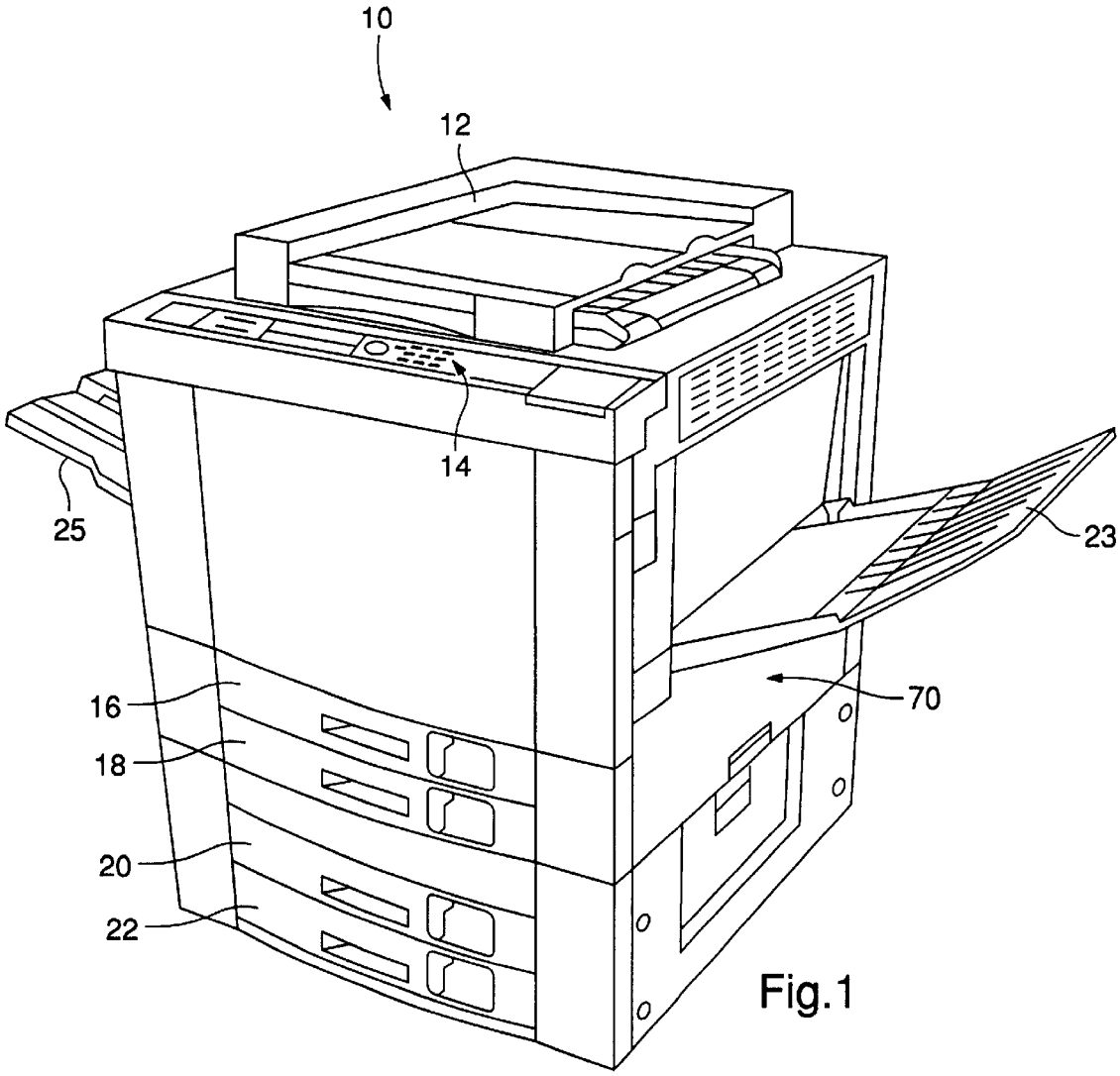
FIG. 1 is a perspective view of an outside appearance of an image formation apparatus of an embodiment of the present invention.

FIG. 1 is a perspective view of external appearance of a copying machine as an embodiment of the image formation apparatus of the present invention.

On the top face of copying machine 10 (an example of the image formation apparatus in the present invention), there is placed an openable document table cover 12. The document table cover 12 also serves as a document feeder (DF) for feeding a source document to the document table. At the front side of the top face, operation panel 14 is placed for inputting the number of reproduced copies, and so forth. This copying machine 10 is capable of forming an image selectively either on a cut paper sheet or on roll paper. This copying machine has four cassettes 16,18,20,22 which store respectively cut paper sheets and are demountable from the main body of copying machine 10. The copying machine has roll paper unit 70 (an example of the roll paper holder of the present invention) which is demountable from copying machine 10. Further, copying machine 10 has manual feed tray 23 for feeding a smaller size of recording paper such as a post card. The copying machine has discharged-paper tray 25 also for holding recording paper sheets after image formation.

The process for formation of an image with copying machine 10 of FIG. 1 is explained below by reference to FIG. 2.

Figure 2:
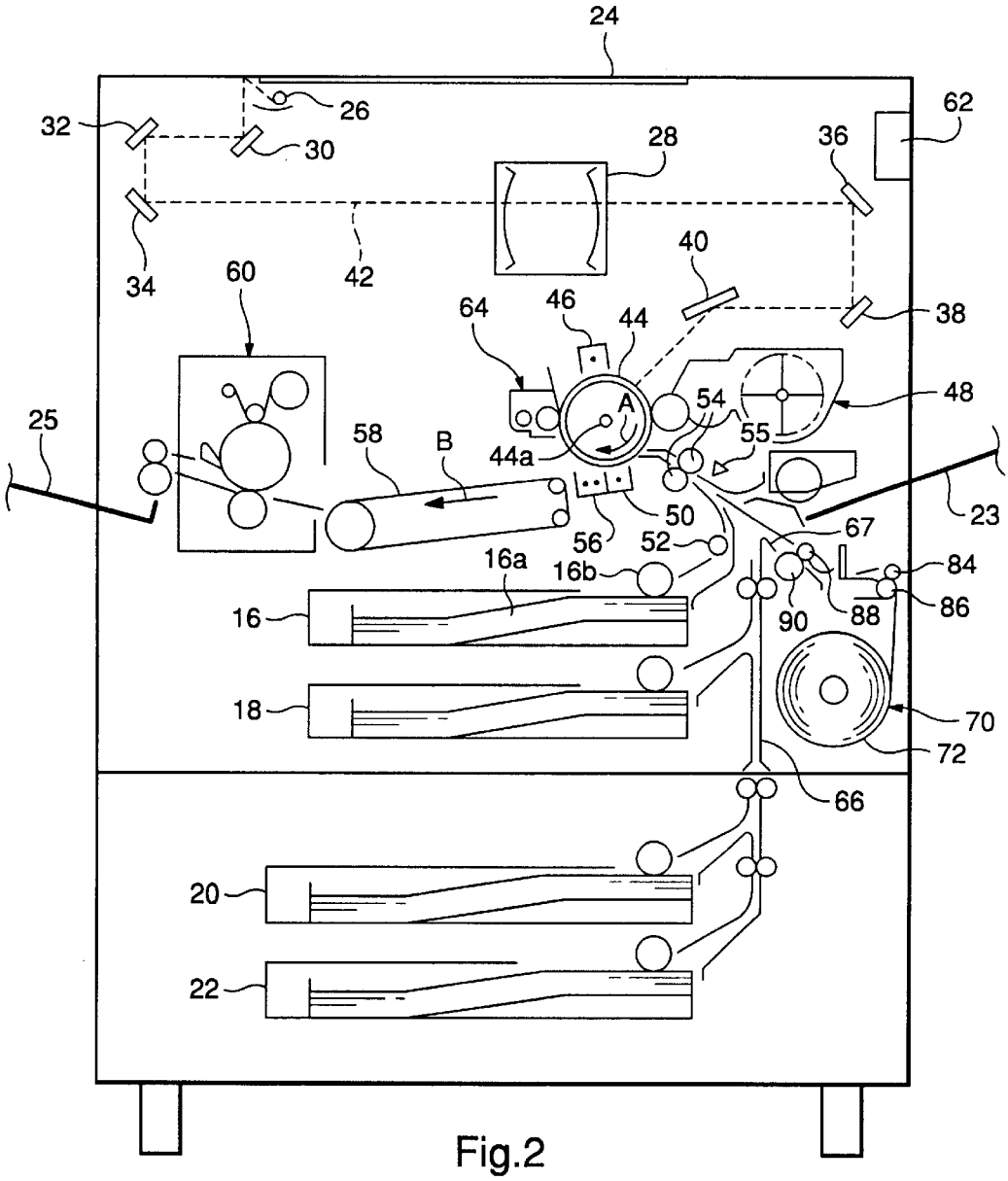
FIG. 2 is a schematic illustration showing roughly the internal structure of a copying machine.

FIG. 2 is a schematic illustration showing roughly the internal structure of copying machine 10.

Document-supporting glass plate 24 is placed under document table cover 12 (see FIG. 1). A light-exposure optical system is provided below document-supporting glass plate 24 to illuminate the source document to obtain image information-carrying signal. This light-exposure optical system includes light source 26, lens 28, mirrors 30,32,34,36,38,40. A source document placed on document-supporting glass plate 24 is exposed to light from light source 26, and reflected light 42 from the source document is projected as image signals through lens 28 and mirrors 30,32,34,36,38,40 to photosensitive drum 44 placed below the light-exposure optical system. Photosensitive drum 44 has a rotation shaft 44*a* in the direction vertical to the drawing paper face, rotating in the direction shown by an arrow A. A primary electrifier 46 is provided on the upstream side, in the rotation direction of photosensitive drum 44, of the position of projection of light 42 reflected by the source document to electrify uniformly photosensitive drum 44. After photosensitive drum 44 is electrified uniformly by primary electrifier 46 to form an electrification face, an electrostatic latent image is formed by projection of reflected light 42 from the source document.

Development device 48 is provided on the downstream side of the above illumination position in the rotation direction of photosensitive drum 44 to develop the electrostatic latent image. The region where photosensitive drum 44 and development device 48 are counterposed is the development region for developing the electrostatic latent image. The electrostatic latent image having arrived at the development region with rotation of photosensitive drum 44 is developed by development device 48 to form a toner image (developed image).

Transfer electrifier 50 is provided on the downstream side of the development region in the rotation direction of photosensitive drum 44 to transfer the toner image onto a recording paper. The region where photosensitive drum 44 and transfer electrifier 50 are counterposed is a transfer region (image formation section) for transferring the toner image onto the recording paper sheet. The toner image having arrived at the transfer region by rotation of photosensitive drum 44 then is transferred onto the recording paper sheet delivered to this transfer region.

The recording paper is delivered from cassette 16,18,20, 22 or roll paper unit 70 to the transfer region. For delivery of the recording paper to the transfer region, for example, a cut paper sheet is sent out from cassette 16 by paper feed roller 16*b*, and the front end of the cut paper sheet 16*a* is kept in contact with registration rollers 54 in a loop form. The cut paper sheet 16*a* is delivered to meet the timing of arrival of the toner image at the transfer region.

In formation of an image on roll paper 72, the roll paper is nipped and delivered by a pair of roll paper feed rollers 84,86 (an example of the first delivery rollers of the present invention) placed above the roll paper 72 and a pair of roll paper delivery rollers (an example of the second delivery roller of the present invention) 88,90 provided on the downstream side of roll paper feed rollers 84,86 in the paper feed direction to registration rollers 54, and is kept waiting there. Then the recording paper is delivered to the image transfer region to meet the timing of arrival of the toner image at the image transfer region. The cutting and feeding of the roll paper 72 is described later in detail.

Cut paper sheet 16*a* or roll paper 72 having received the transferred toner image is separated by separation electrifier 56 from photosensitive drum 44, and is delivered by delivery belt 58 rotating in the arrow-B direction to fixation device 60. By this fixation device 60, the toner image is fixed on the recording paper sheet. After the toner image fixation, the recording paper sheet is discharged through a paper outlet (not shown in the drawing) onto discharged paper tray 25. The toner remaining on photosensitive drum 44 after the image transfer is removed by cleaning device 64 from photosensitive drum 44. The residual electric charge remaining on photosensitive drum 44 is eliminated by a destaticizing lamp (not shown in the drawing). Thus the photosensitive drum 44 is ready for next image formation. Copying machine 10 has a controller 62 (serving as the first, second, and third controlling means of the present invention) for controlling the movement of the aforementioned photosensitive drum 44 and registration rollers 54. This controller 62 controls also the movement of roll paper feed rollers 84,86, roll paper feed rollers 88,90, cutter 100, and so forth. The control of cutter 100 and the related members by controller 62 is described later.

The delivery and cutting of the roll paper is explained by reference to FIGS. 3, 4, and 5.

Figure 3:
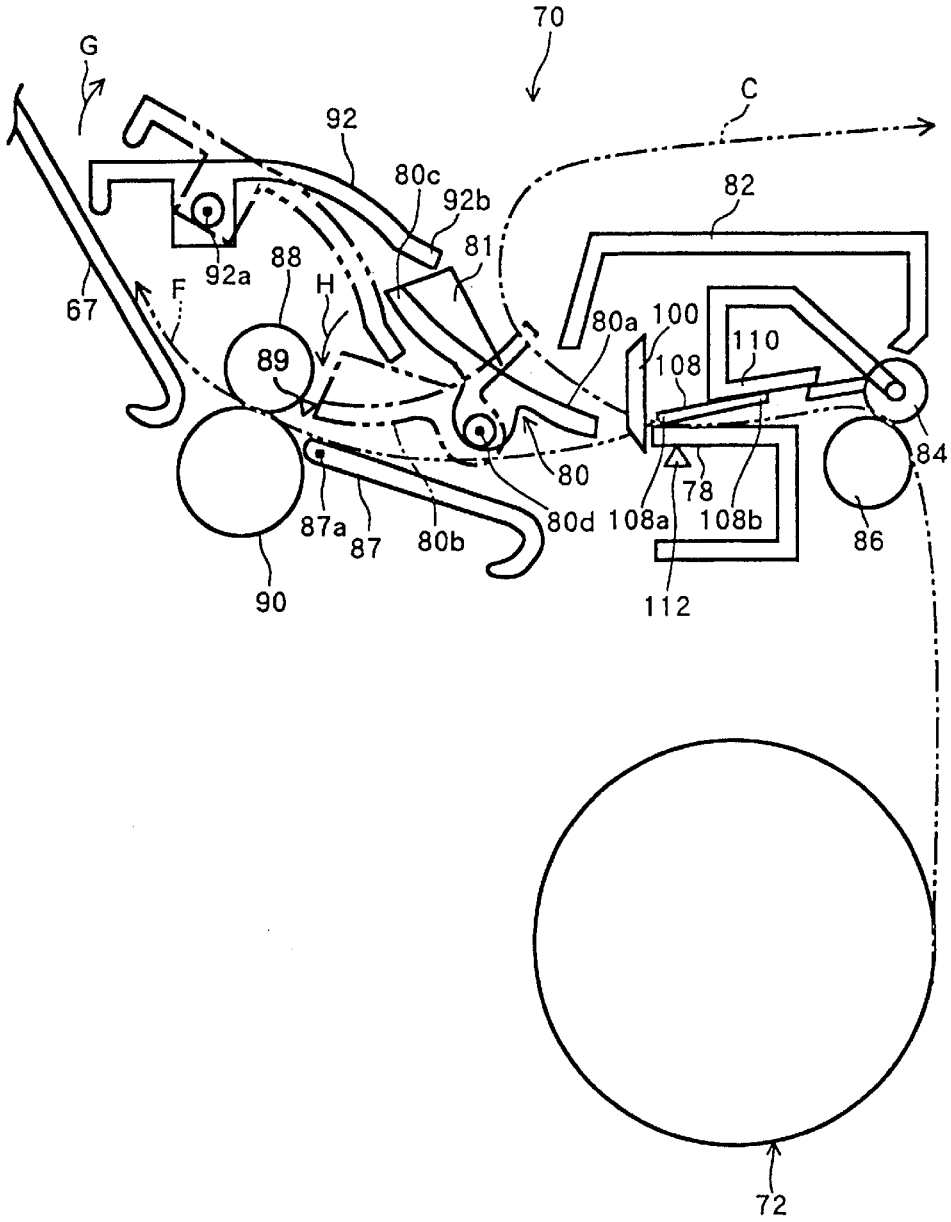
FIG. 3 is a schematic illustration showing a part of a roll paper unit incorporated into a main body of a copying machine, and roll paper not forming a loop.

FIG. 3 is a schematic enlarged illustration of roll paper unit incorporated into the main body of copying machine 10 with roll paper 72 not forming a loop. FIG. 4 is a schematic enlarged illustration of roll paper unit 70 incorporated into the main body of copying machine 10 with roll paper forming a loop. FIG. 5 is a schematic illustration of plate-shaped member 108 viewed from the bottom side thereof. In these drawings, the same numerals and symbols are used for the corresponding constitution elements as in FIG. 2. Incidentally, since the constitution elements are shown schematically and enlargedly, some of the constitution elements are shown in a slightly different shape from that of the corresponding elements in FIG. 2.

After roll paper unit 70 is incorporated into the main body of copying machine 10 by a user, main body guide plate 66 (see FIG. 2) is closed, and first outlet guide plate 67 at the top of main body guide plate 66 is brought into contact with second outlet guide plate 92. Thereby, second outlet guide plate 92 is forced to turn around pivot 92*a* in the arrow-G direction to the position shown by a two-dot chain line. Second outlet guide plate 92 presses down, by rear end portion 92*b* thereof, front end portion 80*c* of guide plate 80, whereby guide plate 80 at the position shown by a solid line is turned around central shaft 80*d* in the arrow-H direction to the position shown by a two-dot chain line. Thereby the path for the paper discharge direction (shown by two-dot chain line C) is closed, and the path shown by two-dot chain line F is opened to deliver roll paper 72 in the paper feed direction.

On the other hand, when roll paper unit 70 is demounted from the main body of copying machine 10 by a user, second outlet guide plate 92 and guide plate 80 turn in the direction reverse to that mentioned above to close the path in the arrow-F direction and to open the path in the arrow-C direction, whereby roll paper 72 is delivered to the discharge direction. Additionally, movable guide 87 is provided between cutter 100 and roll paper delivery rollers 88,90 to deliver roll paper 72 in the direction to correct the curling inclination thereof. This movable guide 87 is turned around pivot 87*a* by the stiffness of roll paper 72 nipped and delivered by roll paper feed rollers 84,86 and roll paper delivery paper 88,90. The turning movement of movable guide 87 is explained later by reference to FIG. 6.

Cutter 100 is provided for cutting the roll paper 72 near cutter lower blade guide 78 on the downstream side thereof. This cutter 100 is usually placed in a waiting position (called a home position (HP) in the present invention) outside the both end sides in the breadth direction of roll paper 72 not to hinder the passage of roll paper 72. Cutter 100 is designed to move in the direction perpendicular to the paper face of FIG. 4 (in the breadth direction of roll paper 72) to cut roll paper 72 when roll unit 70 is incorporated into copying machine 10 with roll paper 72 extending in the paper discharge direction (arrow-C direction).

Flexible plate-shaped member 108 made of a polyester film is provided above the cutter lower blade guide plate 78. Plate-shaped member 108 is nearly rectangular in shape as shown in FIG. 5, and is rounded at the both end corners 108*c* of one side portion 108*a*. In this embodiment, the nipping member as an example is constituted of plate-shaped member 108 and cutter lower blade guide plate 78. One peripheral side portion 108*a* of plate-shaped member 108 presses lightly cutter lower blade guide plate 78, and the other end portion 108*b* is fixed to upper guide 110. Thereby, roll paper 72 passing cutter lower blade guide plate 78 is pressed by the flexible plate-shaped member 108 against cutter lower blade guide plate 78, which enables precise cutting of roll paper 72 by traverse movement of cutter 100. Plate-shaped member 108, which is shown as a rectangular plate in this example, may be constituted of plural divided plates, or may be a metal plate in place of flexible polyester plate member 108. Roll paper 72 is cut by cutter 100 to obtain a recording paper sheet of a prescribed shape corresponding to a cut timing. After cutting the recording paper sheet in the prescribed size, the front end of the remaining portion of the roll paper is nipped by plate-shaped member 108 and cutter lower blade plate 78 as shown in FIG. 4. Detection sensor 112 for detecting the roll paper is provided between the roll paper-nipping position and the position of roll paper feed rollers 84,86. The position of detection sensor 112 is on the upstream side near one side portion 108*a* of plate-shaped member 108, and is the reference position for the measurement of delivery amount of roll paper 72. The roll paper delivery amount is measured by the time between detection of the front end of roll paper 72 by detection sensor 112 and the time of rotation of roll paper feed rollers 84,86. Pre-registration sensor 55 (see FIG. 2) is placed on the upstream side in the paper feed direction near registration rollers 54.

The movement of movable guide 87 is explained by reference to FIGS. 4 and 6.

Figure 6A:
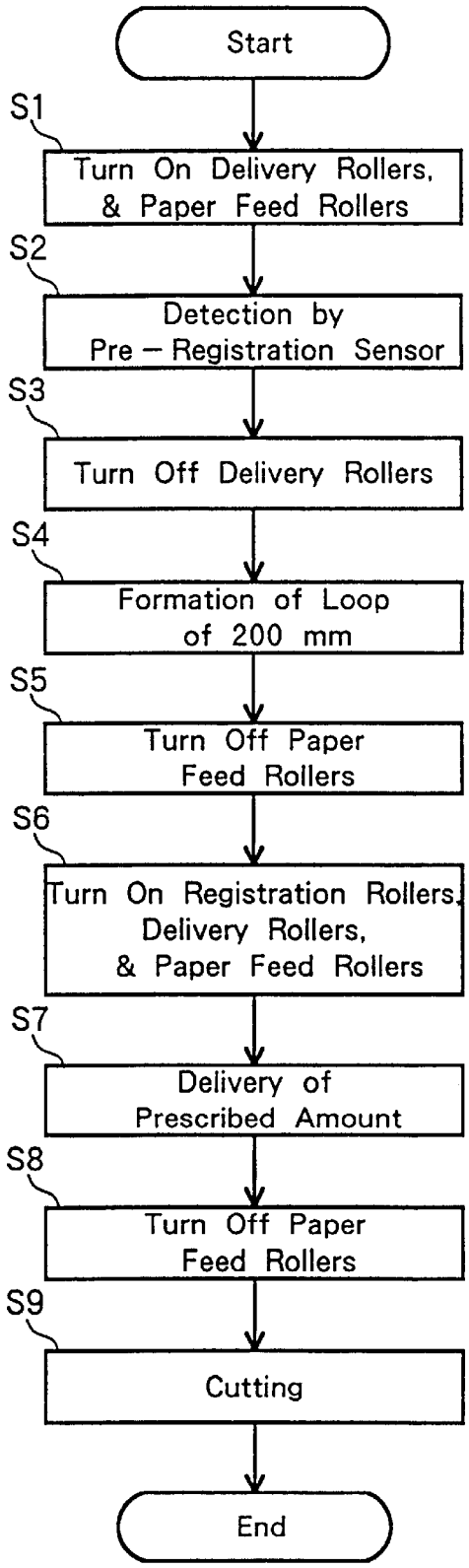
FIG. 6 shows flow charts of a process for control of roll paper feed rollers and related members by a controller equipped in a copying machine, where chart (a) shows a flow for obtaining a recording paper having a length of more than 298 mm in paper feed direction by cutting the roll paper, and chart (*b*) shows a flow for obtaining a recording paper having a length of not more than 298 mm in paper feed direction by cutting the roll paper.
Figure 6B:
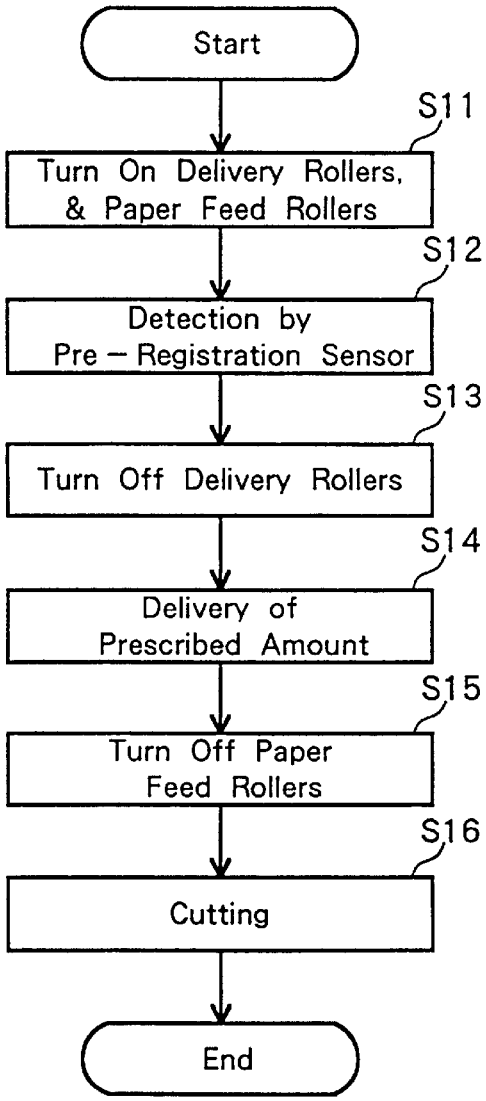

FIG. 6 shows flow charts of a process of control of roll paper feed rollers and the related members by controller 62 equipped in copying machine 10, where chart (a) shows a flow for obtaining a recording paper having a length of more than 297 mm in paper feed direction by cutting the roll paper, and chart (b) shows a flow for obtaining a recording paper having a length of not more than 297 mm in paper feed direction by cutting the roll paper.

Figure 4:
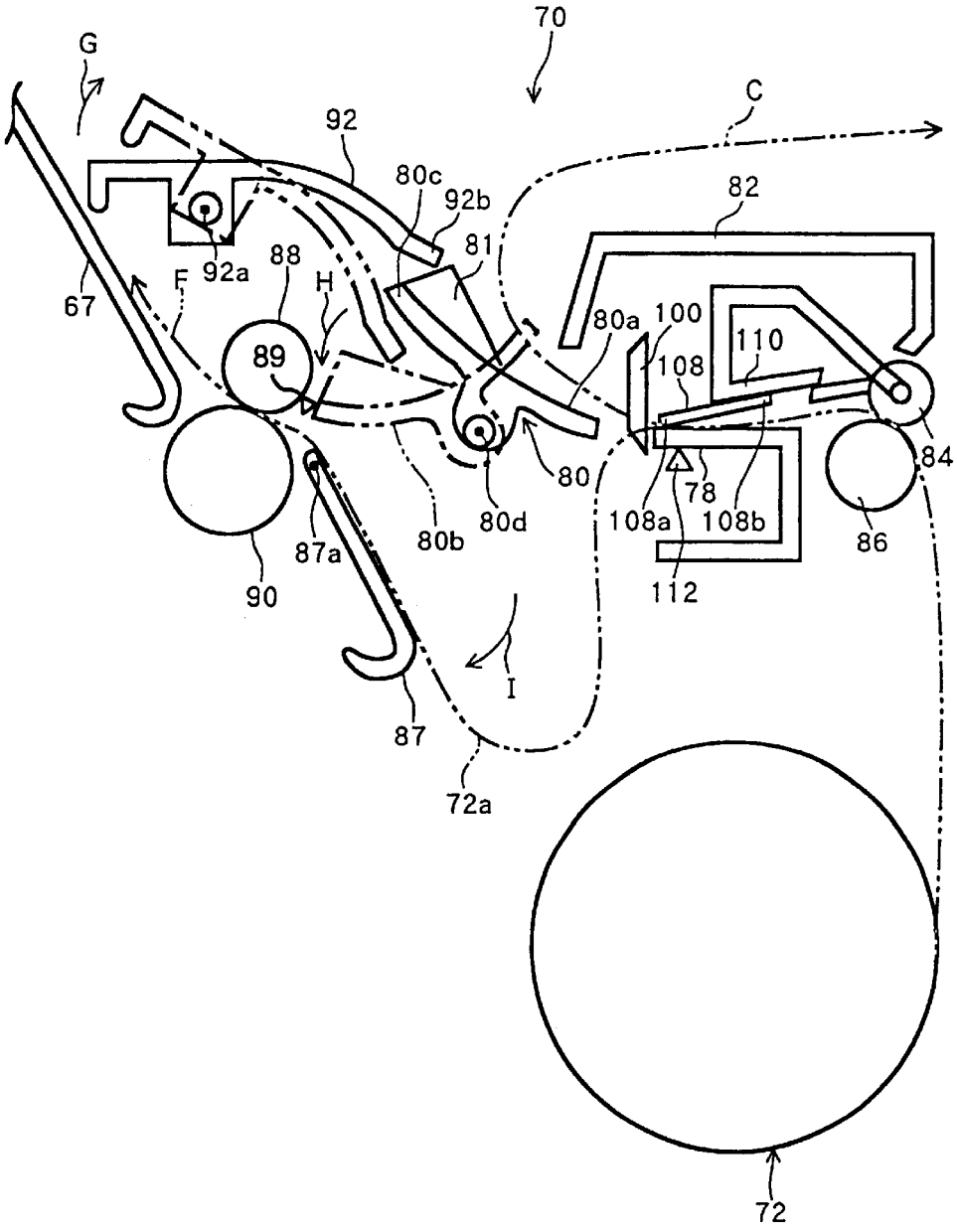
FIG. 4 is a schematic illustration showing a part of a roll paper unit incorporated into a main body of a copying machine, and roll paper forming a loop.
Figure 5:
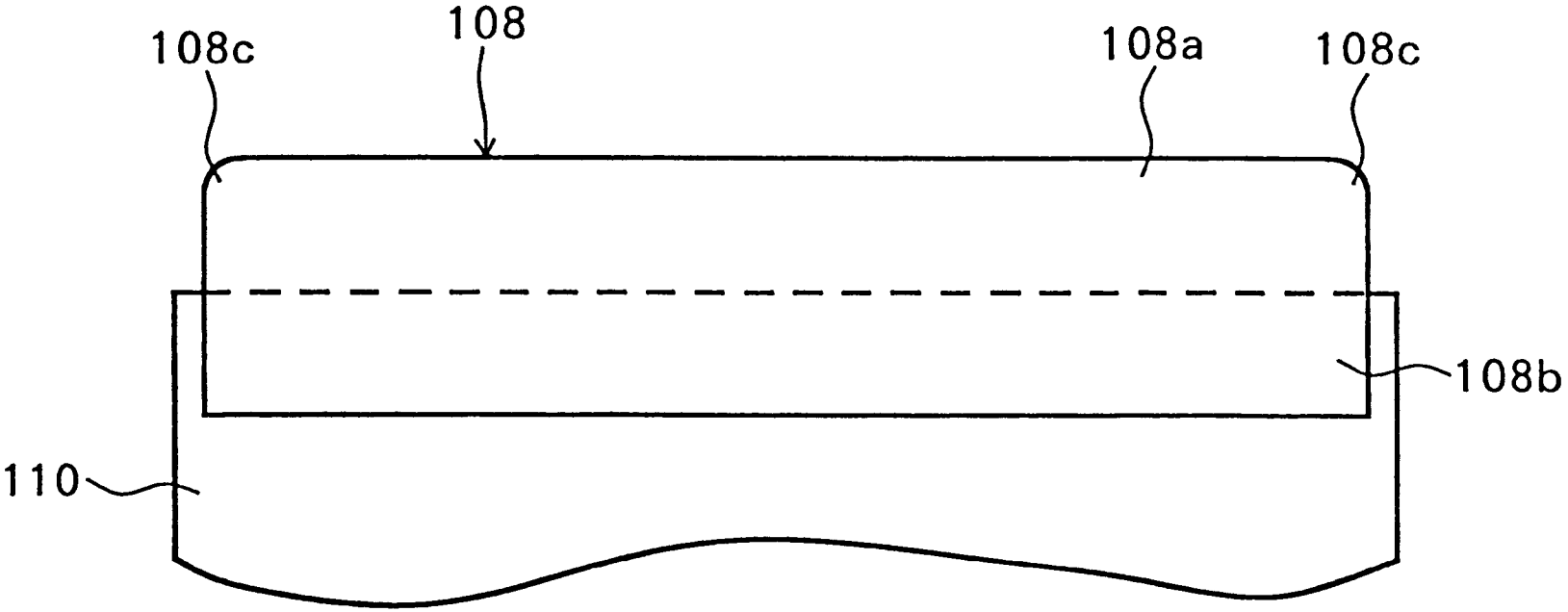
FIG. 5 is a schematic illustration of a plate-shaped member viewed from the bottom side.

Firstly, by reference to FIG. 6(*a*) and FIG. 4, the flow is explained in which the roll paper is cut into a recording paper sheet of longer than 297 mm (an example of the prescribed length in the present invention) in the paper feed direction and an image is formed thereon.

When the copy-start button is turned on, roll paper feed rollers 84,86 and roll paper delivery rollers 88,90 start to rotate, and roll paper 72 begins to be delivered toward registration rollers 54 (see FIG. 2) (S1). When pre-registration sensor 55 has detected roll paper 72 (see FIG. 2) (S2), roll paper delivery rollers 88,90 is stopped (S3). At this point of time, roll paper feed rollers 84,86 keep rotating. Therefore, movable guide 87 is pushed by the stiffness of roll paper 72 to turn around pivot 87*a* in the arrow-I direction. As the result, roll paper 72 forms a loop 72*a* between roll paper feed rollers 84,86 and roll paper delivery rollers 88,90 in a direction reverse to the rolled direction in the paper roll. Thereby, the curling inclination of roll paper 72 which may cause trouble in paper delivery or image formation can be corrected by the formation of loop 72*a*. When loop 72*a* of 200 mm long of paper is formed (S4), roll paper feed rollers 84, 86 are stopped (S5).

Thereafter, roll paper feed rollers 84,86, roll paper delivery rollers 88,90, and registration rollers 54 are rotated (S6) while forming a loop 72*a* of 200 mm long, and a developed image is transferred onto the portion of the roll paper having reached the image-transfer region (not shown in the drawing). After the prescribed amount (prescribed length in paper feed direction) of roll paper 72 has been delivered (S7), roll paper feed rollers 84,86 are stopped (S8), and roll paper 72 is cut by cutter 100 with the timing (an example of the prescribed timing in the present invention) of stop of roll paper feed rollers (S9). In such a manner, an image is formed on roll paper 72, while loop 72*a* is being formed, and roll paper is cut with the timing of stop of paper feed rollers 84,86 on the upstream side of loop 72*a* in paper feed direction. Thus, an image is formed on a recording paper of a desired size.

In the above process, an image is formed on roll paper 72 fed while loop 72*a* is formed in length of 200 mm, and when the prescribed amount of roll paper 72 has been delivered, roll paper 72 is cut during delivery of the loop to obtain a recording paper sheet of a desired size. Accordingly, the space is not necessary to correspond to the length of the recording paper in the paper feed direction regardless of the length of the recording paper sheet. Therefore, registration rollers 54 and roll paper unit 70 may be placed close to each other to make copying machine smaller in size.

Next, a flow of cutting of recording paper into a sheet of not larger than 297 mm in the paper feed direction and forming image thereon is explained by reference to FIG. 6(*b*) and FIG. 4.

When the copy start button is turned on, roll paper feed rollers 84,86 and roll paper delivery rollers 88,90 start to rotate, and roll paper 72 begins to be delivered toward registration rollers 54 (see FIG. 2) (S11). On detection of roll paper 72 by pre-registration sensor 55 (see FIG. 2) (S12), roll paper delivery rollers 88,90 are stopped (S13). At this point of time, roll paper feed rollers 84,86 keep rotating to deliver roll paper 72. When a prescribed amount of roll paper 72 has been delivered (S14), the roll paper delivery rollers 84,86 are stopped (S15). In this state, movable guide 87 is pushed by the stiffness of roll paper 72 to turn around pivot 87*a* in the arrow-I direction. As the result, roll paper 72 forms a loop 72*a* between roll paper feed rollers 84,86 and roll paper delivery rollers 88,90 in a direction reverse to the rolled direction in the paper roll. Thereby, the curling inclination of roll paper 72 can be corrected by the formation of loop 72*a*.

After delivery of the prescribed amount of roll paper 72 as described above, roll paper feed rollers 84,86 are stopped to stop the roll paper, and roll paper 72 is cut by cutter 100 (S16) to obtain a recording paper sheet of a prescribed length. Thereafter, roll paper delivery rollers 88,90, and registration rollers 54 (see FIG. 2) are started to rotate to deliver the cut recording paper sheet of the prescribed length to the image transfer region, and the developed image is transferred thereon. Thereby, an image is formed on a recording paper sheet of the desired size.

Roll paper feed rollers 84,86, when managed to stop the rotation, do not stop instantaneously but rotate a little by inertia before complete stopping. Therefore, when roll paper feed rollers 84,86 are managed on delivery of roll paper in a prescribed amount (S7, S14) to stop roll paper feed rollers (S8, S15), the roll paper is stopped after delivery a little more than the prescribed amount in strict meaning. Therefore, to improve the dimensional precision of the prescribed length of the cut sheet of roll paper 72, the number of times of stopping of roll paper feed rollers 84,86 should be less.

Therefore, in formation of an image on a recording paper sheet of length of not larger than 297 mm in the paper feed direction for higher dimensional precision of the recording paper sheet, cutter 100, roll paper feed rollers 84,86, and roll paper delivery rollers 88,90 are controlled by controller 62 to cut the roll paper (S16) at the first stop of roll paper feed rollers 84,86 (S15).

On the other hand, in formation of image on a recording paper sheet of longer than 297 mm in the paper feed direction, space-saving is preferred to the dimensional precision, and cutter 100, roll paper feed rollers 84,86, and roll paper delivery rollers 88,90 are controlled by controller 62 to cut the roll paper (S9) at the second stop (first stop S5, second stop S8) of roll paper feed rollers 84,86.

As in the above examples explained by reference to FIGS. 4 and 6, when the method of control of cutter 100, roll paper feed rollers 84,86, and roll paper delivery rollers 88,90 is changed with the length of the cut recording paper sheet in the paper feed direction, the control becomes complicated accordingly. To offset this disadvantage, the control of cutter 100, roll paper feed rollers 84,86, and roll paper delivery rollers 88,90 may be conducted invariably through the flow shown in FIG. 6(*a*), regardless of the length of the recording paper sheet cut from the roll paper. With this flow, the control is simpler although the dimensional precision is slightly lower for a smaller size of the recording paper sheet.

Copying machine 10 is capable of forming images not only on roll paper 72 but cut paper sheet 16*a* or the like. In formation of an image on cut paper sheet 16*a,* cut paper sheet 16*a* is delivered by rotating delivery roller 52 (see FIG. 2) with the front end of cut paper sheet 16*a* brought into contact with registration rollers 54, as is well known, for preventing oblique movement of cut paper sheet 16*a,* forming a loop of cut paper sheet 16*a* before registration rollers 54. Thereafter, registration rollers 54 is started to rotate to deliver cut sheet paper 16*a* to the image transfer region.

The cut paper sheet has the end sides precisely forming right angles. Therefore, oblique movement of the cut paper sheet during the delivery from the cassette is prevented by bringing the front end of the cut paper sheet into contact with registration rollers 54 and forming a loop. In contrast, roll paper 72 (see FIG. 2) may have the front end formed by cutting with cutter 100 not at precise right angles relative to the sides in paper feed direction.

If the cut front end side of the cut paper sheet is not at right angles, the contact of the cut front end with the registration rollers, which are normally effective for prevention of oblique movement of the cut paper sheet, will cause oblique movement. Therefore, in copying machine 10, for formation of an image on roll paper 72, roll paper delivery rollers 88,90 are controlled by controller 62 to stop before the edge side of the front end of roll paper 72 having passed through paper delivery rollers 88,90 comes into contact with registration rollers 54, not to form a loop before registration rollers 54 (see S2 and S3, and S12 and S13 in FIG. 6). Thereby, the oblique movement is prevented even when the edge side formed by cutting of cutter 100 of the roll paper is not at right angle to the sides in paper feed direction.

Next, the procedure of control of the roll paper feed rollers and the cutter by controller 62 equipped in copying machine 10 is explained by reference to FIG. 7.

Figure 7:
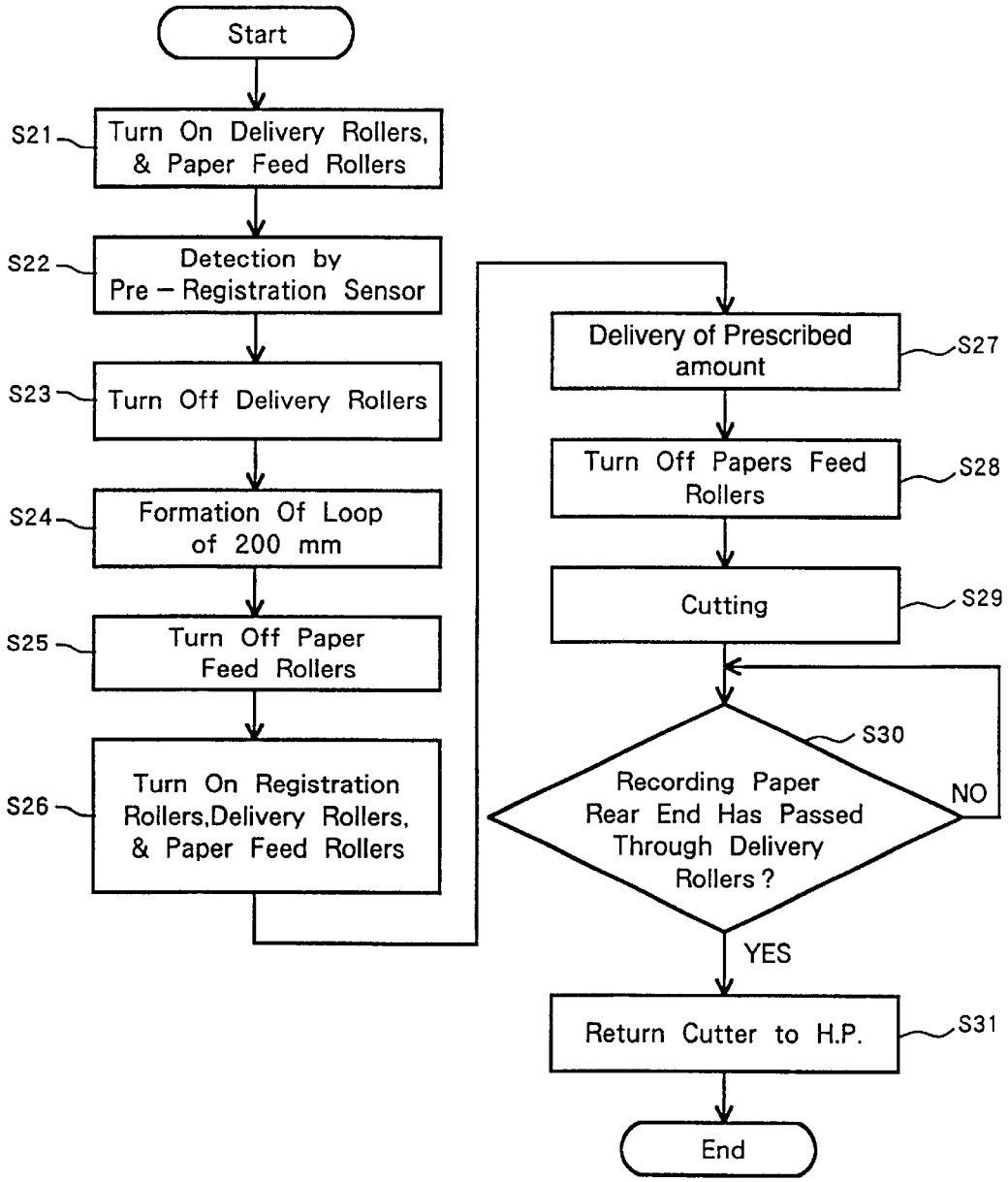
FIG. 7 is a flow chart of a process of control of roll paper feed rollers and related members by a controller equipped in a copying machine.

As shown in FIG. 7, when the copy-start button is turned on, roll paper feed rollers 84,86 and roll paper delivery rollers 88,90 start to rotate and roll paper 72 begins to be delivered toward registration rollers 54 (see FIG. 2) (S21). When roll paper 72 has been detected by pre-registration sensor 55 (see FIG. 2) (S22), roll paper delivery rollers 88,90 are stopped (S23). At this point of time, roll paper feed rollers 84,86 keep rotating. Therefore, movable guide 87 is pushed by the stiffness of roll paper 72 to turn around pivot 87*a* in the arrow-I direction. As the result, roll paper 72 forms a loop 72*a* between roll paper feed rollers 84,86 and roll paper delivery rollers 88,90 in a direction reverse to the rolled direction in the paper roll, as shown in FIG. 4. Thereby, the curling inclination of roll paper 72 can be corrected by the formation of loop 72*a*. When loop 72*a* of 200 mm long is formed (S24), roll paper feed rollers 84,86 are stopped (S25).

Thereafter, roll paper feed rollers 84,86, roll paper delivery rollers 88,90, and registration rollers 54 are rotated, while forming a loop 72*a* of 200 mm long, and a developed image is transferred onto the portion of the roll paper having reached the image-transfer region (not shown in the drawing). After the prescribed amount (prescribed length in paper feed direction) of roll paper 72 is delivered (S27), roll paper feed rollers 84,86 are stopped (S28), and roll paper 72 is cut by cutter 100 with the timing (an example of the prescribed second timing in the present invention) of stopping of roll paper feed rollers 84,86 (S29). In such a manner, an image is formed on roll paper 72 while loop 72*a* is being formed, and roll paper is cut with the timing of stop of paper feed rollers 84,86 at the upstream side of loop 72*a* in paper feed direction. Thus, an image is formed on a recording paper of a desired size.

In the above process, an image is formed on roll paper 72 fed while loop 72*a* of 200 mm long is formed, and when the prescribed amount of roll paper 72 has been delivered, roll paper 72 is cut during delivery of the loop to obtain a recording paper sheet of a desired size. Accordingly, the space is not necessary to correspond to the length of the recording paper in the paper feed direction regardless of the length of the recording paper sheet. Therefore, registration rollers 54 and roll paper unit 70 may be placed close to each other to make copying machine more compact in size.

Cutter 100 is returned to the home position after cutting the roll paper 72. The return of cutter 100 to the home position is decided by detection of passage, through roll paper delivery rollers 88,90, of the rear end of the cut recording paper sheet of the prescribed size obtained by cutting of roll paper 72 (S30). In the vicinity of paper delivery rollers 88,90, a delivery sensor 89 is placed to detect the passage of the rear end of the cut recording paper sheet through roll paper delivery rollers 88,90. The detection of the rear end of the recording paper sheet by this delivery sensor shows the passage of the rear end of the recording paper sheet through roll paper delivery rollers 88,90. After the detection thereof, cutter 100 is returned to the home position (S31).

As mentioned above, cutter 100 is returned to the waiting position after the rear end of the cut recording paper sheet has passed through paper delivery rollers 88,90. This is because, immediately after the cutting of roll paper 72 by cutter 100, the rear end of the cut paper sheet can return to the cutting position owing to the counteraction of loop 72*a,* and the return of cutter 100 to the home position immediately after the cutting may cause cutting of the rear end of the cut recording paper.

Otherwise, cutter 100 may be returned to the home position a sufficient time after the cutting of roll paper 72 by cutter 100. The return of cutter 100 with this timing does not cause the cutting of rear end of the recording paper sheet at all. However, the roll paper cannot be fed for subsequent copying until the cutter 100 has returned to the home position. In consideration of occurrence of cutting of the rear end of the cut recording paper sheet and the feed of the roll paper for the subsequent copying, it is the most desirable to return cutter 100 at the time when the rear end of the recording paper sheet has passed through roll paper delivery rollers 88,90.

The movement of the front end portion of the remaining roll paper 72 (hereinafter referred to as "roll paper front end"), after cutting of the recording paper sheet of the prescribed size is explained below by reference to FIGS. 8 and 9.

Figure 8:
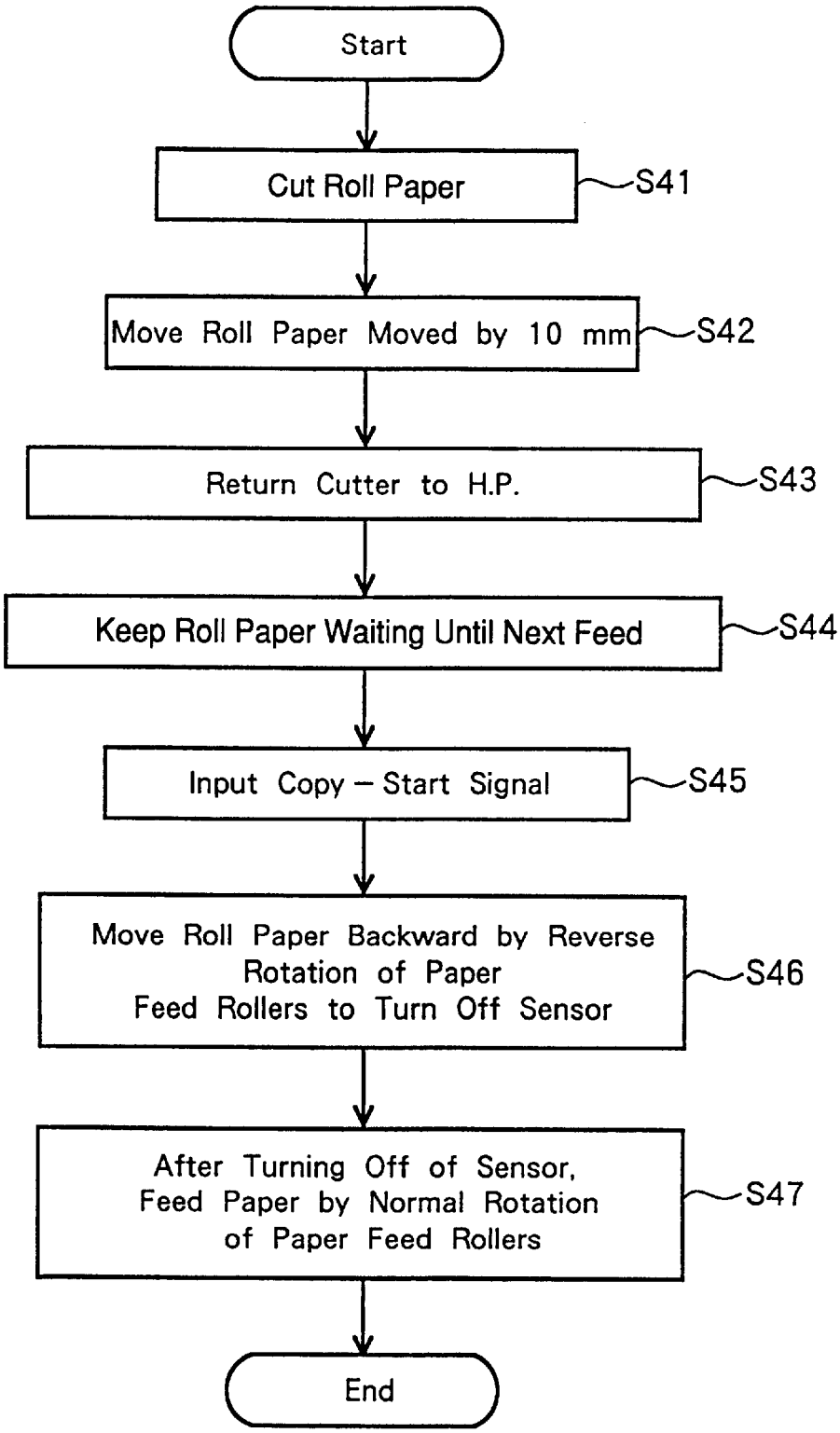
FIG. 8 is a flow chart of a process of moving the front end of a roll paper, after the roll paper is cut, by controlling a roll paper feed roller by a controller equipped in a copying machine.

FIG. 8 is a flow chart showing a process for moving the roll paper front end, after cutting of the roll paper, by controlling roll paper feed rollers 84,86, cutter 100, and related members with controller 62 equipped in copying machine 10. FIG. 9 illustrates schematically the movement of roll paper front end, where illustration (a) shows a state of a cutter and roll paper immediately after the cutting, illustration (b) shows a state of front end of the roll paper held between plate-shaped member 108 and lower cutter blade guide 78, and illustration (c) shows a state of front end of the roll paper having returned to the reference position. In these drawings, the same numerals and symbols are used for the corresponding constitution elements as in FIGS. 2 to 4. Some of the constitutional elements are slightly different in shape from the ones in FIGS. 2 to 4 since they are shown enlargedly and schematically.

Figure 9A:
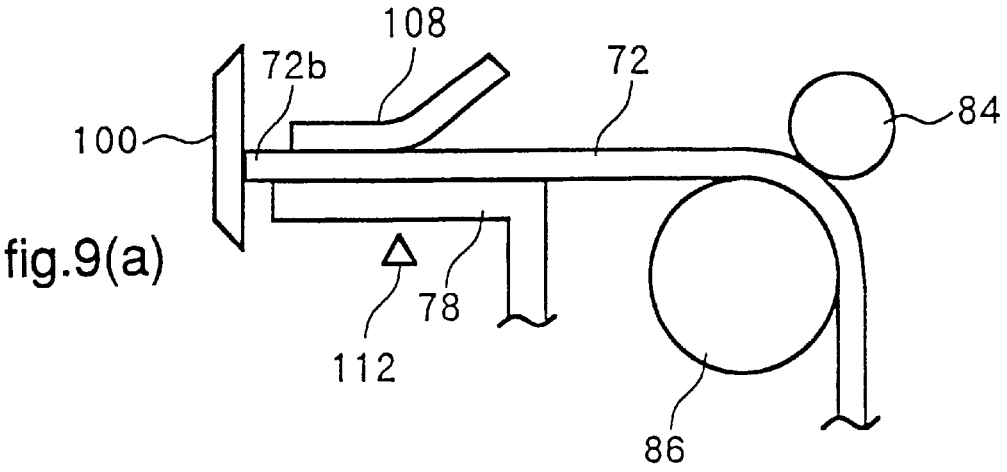
FIG. 9 illustrates schematically movement of front end of roll paper, where illustration (a) shows a state of a cutter immediately after the cutting, illustration (b) shows a state of front end of the roll paper held between a plate-shaped member and a lower cutter blade guide, and illustration (c) shows a state of front end of the roll paper having returned to the reference position.
Figure 9B:
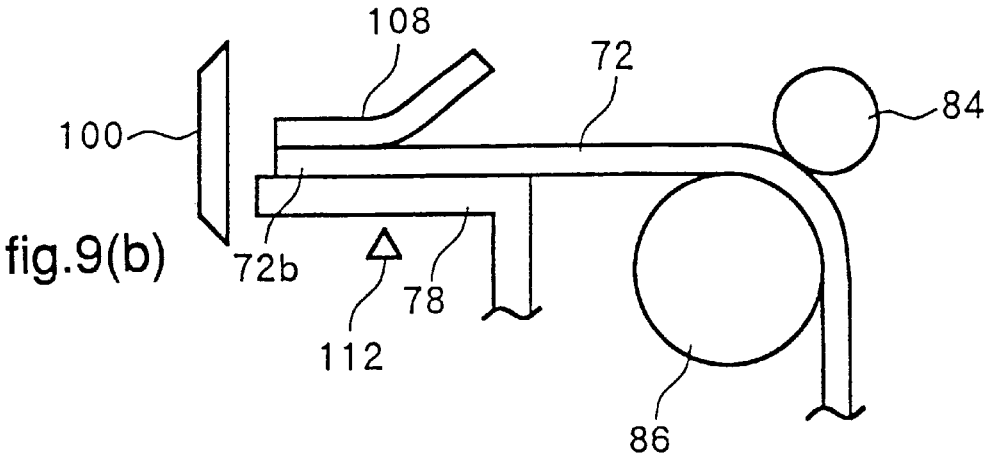
Figure 9C:
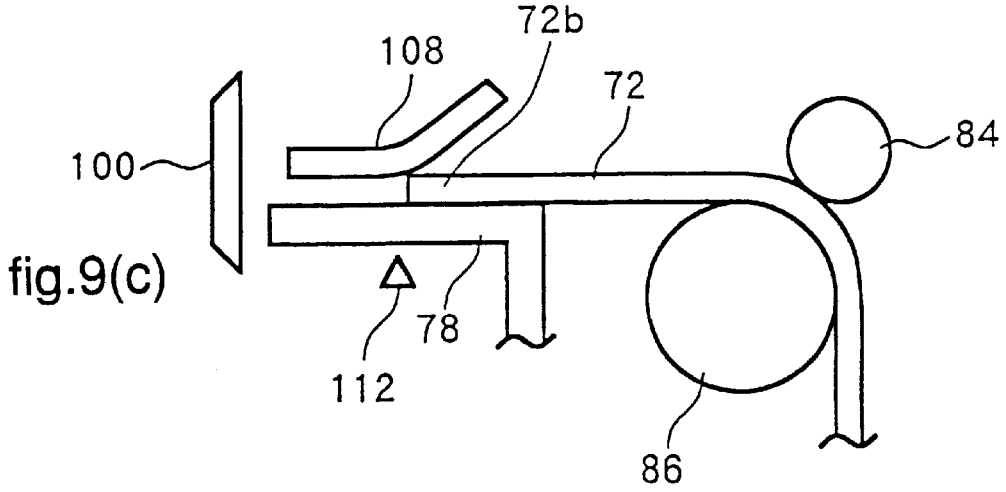

Immediately after roll paper 72 is cut by cutter 100 (S41), cutter 100 and front end 72*b* of the roll paper are at nearly the same position as shown in FIG. 9(*a*). Then, front end 72*b* of the roll paper is moved backward by 10 mm (S42) by rotating roll paper feed rollers 84,86 in the direction reverse to the paper feed direction. Thereby, roll paper front end 72*b* about 40 mm forward from roll paper feed rollers 84,86 is held between plate-shaped member 108 and cutter lower blade guide plate 78. Thereafter, cutter 100 is returned to the home position (HP) (S43). In this state, roll paper front end 72*b* is held between plate-shaped member 108 and cutter lower blade guide plate 78 and cutter 100 is at the home position. This state is kept until the next paper feed (S44). The reason is explained below why roll paper front end 72*b* is held between plate-shaped member 108 and cutter lower blade guide plate 78 until the next paper feed.

Under some environmental conditions, the roll paper absorbs moisture, and causes difference in expansion in the breadth of the recording paper between the portion nipped by rollers and non-nipped portion when roll paper front end 72*b* is held only by roll paper feed rollers 84,86. This results in waving of the portion of roll paper front end 72*b*. If roll paper in this state is delivered, the waved portion of roll paper front end 72*b* may caught by the delivery path to cause paper jamming. Therefore, roll paper front end 72*b* is kept held between plate-shaped member 108 and cutter lower blade guide plate 78 until the next paper feed to prevent waving of paper caused by moisture absorption. Plate-shaped member 108 has a function to press roll paper 72 on cutting roll paper 72 by cutter 100, as described above. In this embodiment, plate-shaped member 108 has functions of pressing and holding roll paper front end 72*b*.

When a copy-start signal is input while roll paper front end 72*b* is kept held between plate-shaped member 108 and cutter lower blade guide plate 78 (S45), roll paper front end 72*b* is moved backward by rotating roll paper feed rollers 84,86 reversely to the paper feed direction to the position where detection sensor 112 is turned off (S46) as shown in FIG. 9(*c*). The timing of inputting the copy-start signal is an example of the prescribed first timing called in the present invention. After roll paper front end 72*b* is once moved backward, roll paper 72 is delivered in the paper feed direction by rotating roll paper feed rollers normally (S47). Thereafter, roll paper feed rollers 84,86 and cutter 100 are controlled according to the flow shown in FIG. 7.

The reason is explained below why roll paper front end 72*b* is moved backward in step S46.

As mentioned above, the position of detection sensor 112 is the reference position for measuring the amount of delivery of roll paper 72. If roll paper front end 72*b* is moved back to cause turning-off of the detection sensor 112 before the input (S45) of the copy-start signal, roll paper front end 72*b* may be deviated from the normal position by user's touch on roll paper unit 70 for paper jamming treatment or other operation. In this case, the amount of the paper delivery cannot be measured precisely, resulting in a recording paper sheet of a size different from the set value. Therefore, after the input of copy-start signal (S45), roll paper front end 72*b* is moved backward to the position where detection sensor 112 is turned off (S46). Thereby, the recording paper can steadily be cut precisely in the same size as set by the user.

INDUSTRIAL APPLICABILITY

As described above, in the first embodiment of the image formation apparatus of the present invention, the cutter, the first and second delivery rollers are controlled by the first controlling means such that an image is formed on the roll paper while a loop of the roll paper is formed and the roll paper is cut with a prescribed timing. Thereby, the roll paper can be cut by the cutter during delivery of the roll paper and image formation thereon even if the length of the recording paper obtained by cut of the roll paper is very large. Therefore, a large space is not necessary corresponding to the length of the cut recording paper sheet. Thus the image formation apparatus can be made smaller, and more readily handleable.

In the second embodiment of the image formation apparatus of the present invention, the control mode of the cutter and the first and second delivery rollers is switched by the second controlling means according to whether or not the length of the portion for image formation in the paper feed direction is larger than the prescribed length. Therefore, the apparatus can be controlled to obtain high dimensional precision for a small size of a recording paper sheet of length in paper feed direction smaller than the prescribed length, and the apparatus can form an image on a large size of a recording paper sheet of length in paper feed direction larger than the prescribed length. Thereby, the image formation apparatus can be made smaller, and more readily handleable.

In this apparatus, the curling inclination of roll paper can be reduced by providing a movable guide which is provided between the cutter and the second delivery rollers to guide the roll paper delivered by the first and second delivery rollers to form a loop in the direction for offsetting the curling inclination.

In this apparatus, oblique movement of the roll paper front is prevented and the apparatus can be made smaller by providing a third delivery rollers and a third controlling means: the third delivery rollers being placed on the downstream side of the second delivery rollers in the paper-feed direction, forming a loop by contact with the recording paper, and delivering the recording paper with the timing of image formation in the paper feed direction; and the third controlling means controlling the second delivery rollers to stop before the roll paper delivered by the second delivery rollers forms a loop by contact with the third delivery rollers.

The image formation apparatus of the third embodiment of the present invention has a nipping member for nipping the front end of the roll paper. This nipping member nipping the front end of the roll paper prevents the roll paper front end to become wavy by moisture absorption, and offsets inconvenience after cutting of the roll paper by the cutter. Thereby the image formation apparatus is made more readily handleable.

By providing the first controlling means for controlling the first delivery roller, after cutting of the roll paper, to move the front end of the remaining roll paper separate from the cut recording paper sheet of the prescribed size to the position of nipping by the nipping member, the waving of the roll paper front end owing to moisture absorption can be surely prevented since roll paper front end is nipped by the nipping member after cutting of the roll paper.

The amount of paper delivery can be measured precisely and the recording paper can be obtained in the same size as set by the user by providing a detection sensor which is placed at the reference position for measurement of the delivery amount of the roll paper between the nipped position of the front end of the remaining roll paper by the nipping member and the position of the first rollers, and by employing the first controlling means to control the first delivery rollers to move backward the front end of the remaining roll paper from the position nipped by the nipping member to the position to be detected by the detection sensor with a prescribed timing.

In the fourth embodiment of the image formation apparatus of the present invention, the second controlling means is controlled so as to return the cutter to the home position after the rear end of the recording paper sheet has passed through the second delivery rollers. Therefore, undesired cutting of the rear end of the recording paper sheet is prevented, and the inconvenience after cutting of the roll paper can be avoided. Thereby, the image formation apparatus can be made more readily handleable.

What is claimed is:

1. An image formation apparatus having a roll paper holder for holding a roll paper, first delivery rollers for delivering the roll paper from the roll paper holder in a paper feed direction, a cutter placed on a downstream side of the first delivery rollers in the paper feed direction for cutting the roll paper, second delivery rollers placed on the downstream side of the cutter in the paper feed direction for delivering the roll paper in the paper feed direction; and forming an image on the roll paper delivered by the first delivery rollers and the second delivery rollers:

the image formation apparatus comprising a controlling means which controls the cutter, the first delivery rollers, and the second delivery rollers so as to form a loop of the roll paper between the first delivery rollers and the second delivery rollers, to form an image on the roll paper before cutting, and to cut the roll paper with the cutter with a prescribed timing.

2. The image formation apparatus according to claim 1, wherein the image formation apparatus has a movable guide which is placed between the cutter and the second delivery rollers and guides the roll paper delivered by the first and the second delivery rollers to form a loop in a direction to correct curling inclination of the roll paper.

3. The image formation apparatus according to claim 2, wherein the image formation apparatus has third delivery rollers which are placed on the downstream side in the paper feed direction of the second delivery rollers to form a loop by contact with the recording paper and to deliver the recording paper in the paper feed direction to meet the timing of image formation, and a delivery roller controlling means which controls the second delivery rollers to stop before the roll paper having passed through the second delivery rollers forms a loop by contact with the third delivery rollers.

4. The image formation apparatus according to claim 1, wherein the image formation apparatus has third delivery rollers which are placed on the downstream side in the paper feed direction of the second delivery rollers to form a loop by contact with the recording paper and to deliver the recording paper in the paper feed direction to meet the timing of image formation, and a delivery roller controlling means which controls the second delivery rollers to stop before the roll paper having passed through the second delivery rollers forms a loop by contact with the third delivery rollers.

5. An image formation apparatus having a roll paper holder for holding a roll paper, first delivery rollers for delivering the roll paper from the roll paper holder in a paper feed direction, a cutter placed on the downstream side of the first delivery rollers in the paper feed direction for cutting the roll paper, second delivery rollers placed on the downstream side of the cutter in the paper feed direction for delivering the roll paper in the paper feed direction; and forming an image on the roll paper delivered by the first delivery rollers and the second delivery rollers:

the image formation apparatus comprising a controlling means which controls the cutter, the first delivery rollers, and the second delivery rollers to stop once the roll paper delivered by the first delivery rollers and the second delivery rollers and to cut the roll paper before image formation on the roll paper, when an image formation portion of the roll paper is not longer than a prescribed length in the paper feed direction; or to form a loop of the roll paper between the first delivery rollers and the second delivery rollers, to form an image on the roll paper before cutting, and to cut the roll paper with the cutter with a prescribed timing, when an image formation portion of the roll paper is longer than the prescribed length in the paper feed direction.

6. The image formation apparatus according to claim 5, wherein the image formation apparatus has a movable guide which is placed between the cutter and the second delivery rollers and guides the roll paper delivered by the first and the second delivery rollers to form a loop in a direction to correct curling inclination of the roll paper.

7. The image formation apparatus according to claim 6, wherein the image formation apparatus has third delivery rollers which are placed on the downstream side in the paper feed direction of the second delivery rollers to form a loop by contact with the recording paper and to deliver the recording paper in the paper feed direction to meet the timing of image formation, and a delivery roller controlling means which controls the second delivery rollers to stop before the roll paper having passed through the second delivery rollers forms a loop by contact with the third delivery rollers.

8. The image formation apparatus according to claim 5, wherein the image formation apparatus has third delivery rollers which are placed on the downstream side in the paper feed direction of the second delivery rollers to form a loop by contact with the recording paper and to deliver the recording paper in the paper feed direction to meet the timing of image formation, and a delivery roller controlling means which controls the second delivery rollers to stop before the roll paper having passed through the second delivery rollers forms a loop by contact with the third delivery rollers.

9. An image formation apparatus having a roll paper holder for holding a roll paper, delivery rollers for delivering the roll paper from the roll paper holder in a paper feed direction, and a cutter placed on the downstream side of the delivery rollers in the paper feed direction for cutting the roll paper delivered from the delivery rollers into a prescribed size of a recording paper sheet; and forming an image on the recording paper sheet of the prescribed size: the image formation apparatus comprising a nipping member placed on the upstream side of the cutter in the paper feed direction to nip the front end of the remaining roll paper separate from the cut recording paper of the predetermined size, wherein said nipping member comprises a flexible plate and a rigid plate.

10. The image formation apparatus according to claim 9, wherein the image formation apparatus has a controlling means which controls the delivery rollers to move the front end of the remaining roll paper backward, after the cutting of the roll paper by the cutter, to the position where the front end is nipped by the nipping member.

11. The image formation apparatus according to claim 10, wherein the image formation apparatus has a detection sensor which is placed at a reference position between the position of nipping of the front end of the remaining roll paper by the nipping member and the position of the delivery rollers for measuring the delivery amount of the roll paper and detects the roll paper; and the controlling means which controls the delivery rollers to move the front end of the remaining roll paper backward from the position of nipping of the front end by the nipping member to the detection position of the detection sensor with a prescribed first timing.

12. An image formation apparatus having a roll paper holder for holding a roll paper, a first delivery rollers for delivering the roll paper from the roll paper holder in a paper feed direction, a cutter placed on a downstream side of the first delivery rollers in the paper feed direction for cutting the roll paper delivered from the first delivery rollers into a prescribed size of recording paper sheet, and second delivery rollers placed on the downstream side of the cutter in the paper feed direction to deliver the recording paper sheet of the prescribed size in the paper feed direction; and forming an image on the recording paper sheet of the prescribed size:

the image formation apparatus comprising a controlling means for controlling the cutter, the first delivery rollers, and the second delivery rollers to form an image on the roll paper while forming a loop of the roll paper between the first delivery rollers and the second delivery rollers, and to cut the roll paper by the cutter with a prescribed second timing to obtain a recording paper sheet of the prescribed size, and for controlling the cutter to return to a home position when the rear end of the recording paper sheet of the prescribed size has passed through the second delivery roller.

* * * * *